United States Patent [19]

Shlesinger, Jr. et al.

[11] 4,039,985

[45] Aug. 2, 1977

[54] MAGNETIC REED SWITCH

[76] Inventors: B. Edward Shlesinger, Jr., 9411 Macklin Court, Alexandria, Va. 22309; Charlie Dwain Mariner, 2846 Greenway Blvd., Falls Church, Va. 22042

[21] Appl. No.: 647,774

[22] Filed: Jan. 9, 1976

Related U.S. Application Data

[60] Continuation-in-part of Ser. No. 611,156, Sept. 8, 1975, Pat. No. 4,038,620, which is a continuation-in-part of Ser. No. 533,233, Dec. 16, 1975, abandoned, which is a division of Ser. No. 404,612, Oct. 9, 1973, Pat. No. 3,866,007.

[51] Int. Cl.[2] ..... H01H 1/66

[52] U.S. Cl. ..... 335/153; 335/154; 335/207

[58] Field of Search ..... 335/151, 152, 153, 154, 335/205, 206, 207

[56] References Cited

U.S. PATENT DOCUMENTS

| | | | |
|---|---|---|---|
| 3,205,323 | 9/1965 | Deshautreaux | 335/207 |
| 3,283,274 | 11/1966 | DeFalco | 335/206 |

*Primary Examiner*—George Harris
*Attorney, Agent, or Firm*—Shlesinger, Arkwright, Garvey & Dinsmore

[57] ABSTRACT

A reed switch comprising a first reed of conductive magnetic material and a second reed of conductive non-magnetic material mounted in cooperating spaced relation to said first reed and a cooperating pair of magnetic operators mounted in spaced relation to said first and second reeds and said reeds being positioned between said pair of operators, and including a third operator cooperating with the pair of operators to influence one or the other of said operators to shift said first reed into a first mode or a second mode and latch said first reed in said mode.

31 Claims, 17 Drawing Figures

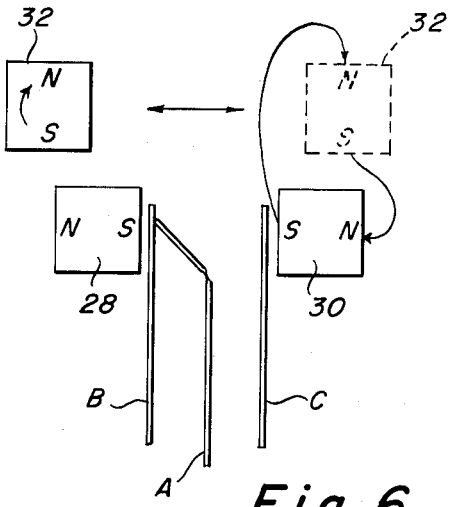
Fig. 6
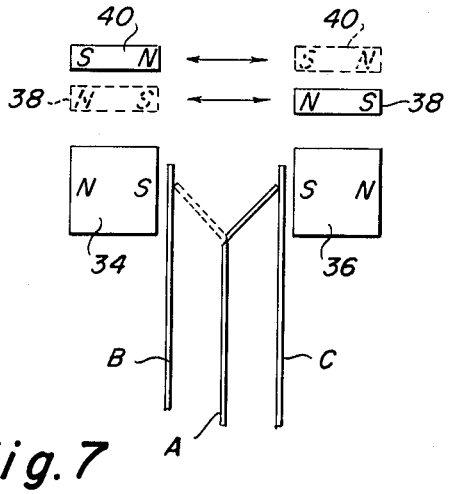
Fig. 7
Fig. 8
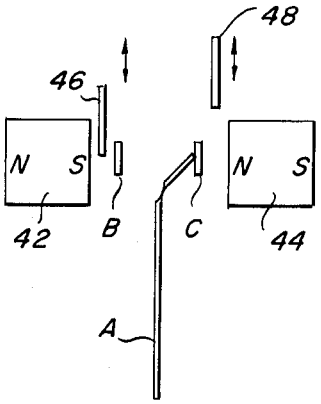
Fig. 9
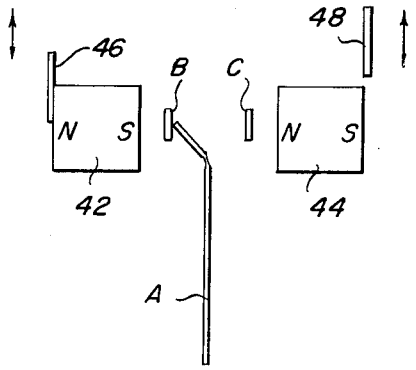
Fig. 10
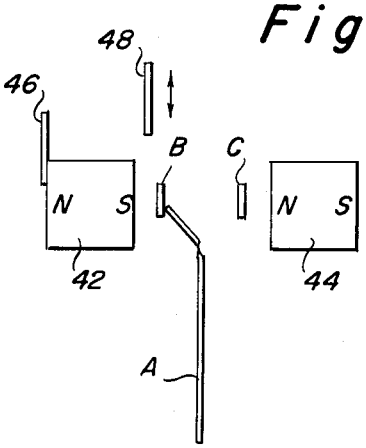
Fig. 11
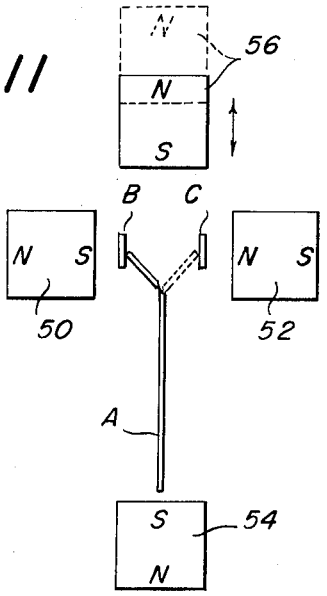

MAGNETIC REED SWITCH

This invention is continuation-in-part of Ser. No. 611,156 filed Sept. 8, 1975, now U.S. Pat. No. 4,038,620, issued July 26, 1977, which is a continuous-in-part of Ser. No. 533,233, filed Dec. 16, 1975 now abandoned, which is a division of Ser. No 404,612, filed Oct. 9, 1973, now U.S. Pat. No. 3,866,007, issued Feb. 11, 1975.

HISTORICAL BACKGROUND

Very little has been done in the area of reed switches using a non-magnetic reed with a magnetic reed. Ellwood U.S. Pat. No. 2,264,746, Karrer U.S. Pat. No. 2,922,856, and Bentz U.S. Pat. No. 3,359,385 do disclose magnetic reeds working in conjunction with non-magnetic reeds; however, in each instance, there is a third reed which is magnetic and the actual operation of the switches is dependent upon a magnetic field acting upon the two magnetic reeds to cause them to close together to complete an electrical circuit at the same time as the two magnetic reeds complete a magnetic circuit. In these patents, the magnetic forces bring the reeds together so that the magnetic circuit is closed. The operation of the switches of this invention are not at all based upon the completion of a magnetic circuit as is typical in prior art magnetic reeds. Operation of this invention is dependent only on the attraction or repulsion of a single reed and the magnetic forces as they affect this reed. There is no completion of a magnetic circuit when the device is operating as in the case of the prior art, where the non-magnetic reed is merely positioned for a single pole-double throw system in which one of the magnetic reeds rests against the non-magnetic reed prior to operation of the magnetic field effect.

In addition to the art referred to, attention is called to DeFalco U.S. Pat. No. 3,283,274 and Shlesinger U.S. Pat. No. 3,760,312 which are typical of the prior art not including a non-magnetic reed.

Attention is also called to our U.S. Pat. No. 3,893,051 of July 1, 1975, which discloses electromagnetic devices operating on a typical reed system such as disclosed in this invention.

Historically, latching, i.e., a system in which a reed is carried to one side or the other and maintains its latched or unlatched position as the case may be, even after the magnetic field is either turned off or removed as, for example, by removing the magnet, has required extremely complex and expensive equipment. There has been no simple reed structure available which is both compact and inexpensive. In some instances, latching had to be carried on by a whole series of switches rather than a single unit.

OBJECTS AND SUMMARY

It is therefore an object of this invention to provide a magnetic reed switch which has latching capabilities.

A further object of this invention is to provide a magnetic reed switch for latching purposes with greater reduction in size and an increase in current carrying capacity greater than heretofore available.

Another object of this invention is to provide a magnetic reed switch which can be inexpensively and readily manufactured.

Still a further object of this invention is to provide a magnetic reed switch which has great durability and which can take severe strain and stress and can withstand high acceleration and deceleration forces once it has been latched without actuation or unlatching.

Yet a further object of this invention is to provide a magnetic reed switch which incorporates therein a magnetic conductive reed and a non-magnetic conductive reed capable of being operated by one or more permanent or electromagnets.

Yet another object of this invention is to provide a magnetic reed switch having many options of operation including various on-off combinations and directional control operation.

It is a further object of this invention to provide a magnetic reed switch which has an extremely rapid closing time.

Yet another object of this invention is to provide a magnetic reed switch in which a minimum amount of work is done in order to operate the switch.

Still a further object of this invention is to provide a reed switch which has a strong snap action so as to crunch or otherwise break through any oxide build-up increasing the longevity of the switch and eliminating malfunction.

Yet a further object of this invention is to provide a magnetic reed switch which has good contact wipe characteristics.

Yet a further object of this invention is to provide a reed switch which improves conductivity characteristics with use.

Another object of this invention is to provide a magnetic reed switch which can be adapted to many shapes and forms.

Another object of this invention is to provide a magnetic reed switch capable of being used in linear and radial configurations and combinations.

A further object of this invention is to provide a reed switch in which unlatching can be done by a shorting operation in which the magnetic circuit is shorted out.

Yet another object of this invention is to provide a magnetic reed switch which may be operated through a very short incremental distance.

In summary, therefore, this invention is directed to magnetic reed switches of either the permanent or electromagnetic type having a strong closing action and long life. These and other objects of this invention will be apparent from the following description and claims.

In the accompanying drawings which way of example vertical embodiments of this invention:

FIGS. 6 and 7 are fragmentary side elevational views diagrammatically showing other embodiments of this invention;

FIGS. 8, 9 and 10 are side elevational views of further embodiments of this invention showing different magnetic field shunting or shorting arrangements;

FIG. 11 is a side elevational view diagrammatically illustrating yet another embodiment of this invention;

FIGS. 1 THROUGH 5

Figure 1:
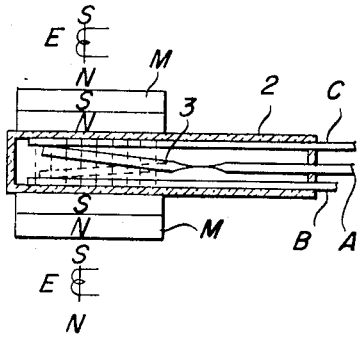
FIGS. 1, 2 and 3 are side elevational diagrammatic views showing the reed switch in various phases of operation.
Figure 2:
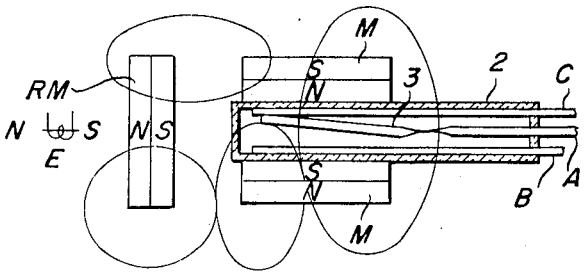
Figure 3:
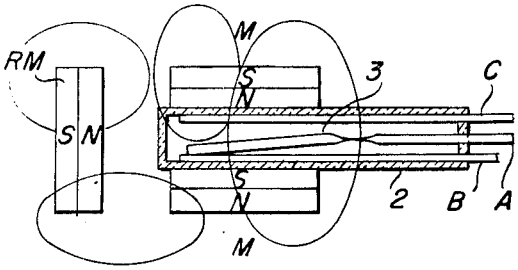

FIGS. 1, 2 and 3 show a housing 2 in which the magnetic reed A is positioned between non-magnetic reeds B and C for the purpose of providing a single pole-double throw switch mechanism. Upper and lower magnets M are provided which are fixed position magnets and they may be glued or otherwise secured to the housing 2, or, as illustrated in the case of FIG. 1, a small electromagnet might be provided adjacent the housing 2 or otherwise secured thereto as by means of adhesive or the like. The reed A may have its contact in the solid line up position or in the dotted line down position as illustrated in FIG. 1. It will be noted that the lines of force are substantially perpendicular to the reeds. It will now be observed in FIGS. 2 and 3 that the rotating magnet RM, when having its south pole pushing the south pole of the lower magnet M and aiding the north pole of the upper magnet M, will maintain the contact 3 of the reed A in the upper position, or if the contact 3 is in the lower position, it will shift it to the upper position due to the greater magnetic attractive forces influencing the magnetic field in the direction of the upper magnet. Similarly, as shown in FIG. 3, a reversal of the rotating magnet RM, will shift the reed to the lower position since the magnetic forces are now switched to cause a greater attraction of the lower magnet M than the upper magnet M. Removing the rotating magnet RM will, of course, leave the contact 3 in whatever position it was at the time the rotating magnet was removed. This provides a latching mechanism for the switch and assures a positive positioning in either direction as desired. It is also to be noted that the influencing rotating magnet RM may be brought into position, not necessarily at the end of the reeds as illustrated in FIGS. 2 and 3, but may be brought into position anywhere within the range of the magnetic fields of the two stationary magnets M which, of course, allows the positioning of the rotating magnet RM anywhere about the package so long as there is sufficient influence upon the fields of the two stationary upper and lower magnets. This phenomenon is unique and provides a switch with a memory characteristic. The reed will not flip out once it is positioned even though the magnet RM is shifted away and removed. In place of the rotary magnet RM, an electromagnet E may be provided as in FIG. 2 with means (not shown) for changing the direction of current flow through the coil of the electromagnet E. Obviously, a belt system drive could move a series of magnets into position alternately switching the reed A from an up position to a down position. Although a single pole-double throw system is shown, it is obvious that other type systems could be utilized including single pole-single throw or double pole-double throw, etc.

Figure 4:
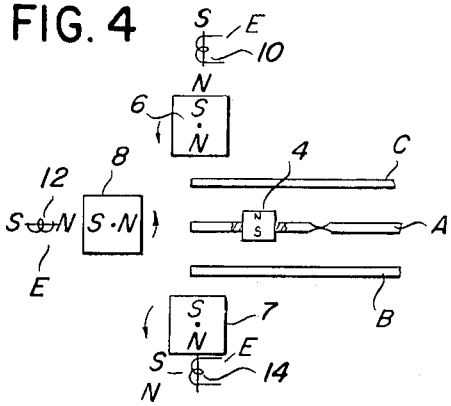
FIG. 4 is a side elevational diagrammatic view of still another modification of this invention.

In FIG. 4, the reed A is provided with a permanent magnet 4. The upper magnet 6, the lower magnet 7, and the interferring magnet 8 are all rotatable and may be substituted for electromagnets 10, 12 and 14. In this instance the small fixed permanent magnet 4 is utilized as a null or mid-positioning magnet. Thus, if the magnets 6 and 7 use repelling fields as illustrated, the reed A will be maintained in a mid-position between the contact reeds B and C as illustrated. Any rotation of various magnets 6, 7 and 8 will, of course, affect the positioning of the reed A relative to the reeds B and C depending upon the positioning of the pole of the magnets 6, 7 and 8 or the operation of the electromagnets 10, 12 and 14, which may be reversed by changing the current flow in order to shift the polarity of the electromagnets, thus causing a new switching funtion. Thus, if the magnet 8 is strong enough to override any one of the systems, it will shift the reed A in the direction of the strongest system. Similarly, this is true with rotation or reversion of the magnets 6 and 7 or actuation of the electromagnets 10 and 14 to reverse fields as desired.

Figure 5:
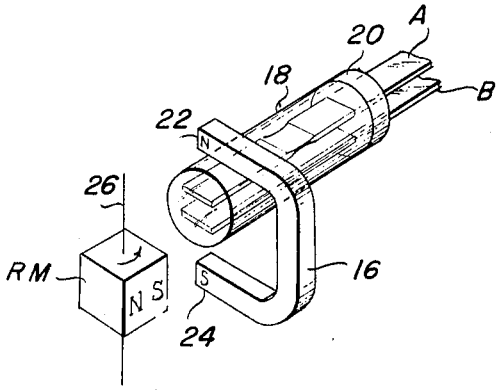
FIG. 5 is a diagrammatic fragmentary isometric view of yet another embodiment of this invention.

FIG. 5 shows a horseshoe magnet 16 positioned above the capsule 18 in which reeds A and B are positioned within the base 20. The poles 22 and 24 are oriented so that the polar axis extending through the poles 22 and 24 is transverse to the planes of the reeds A and B. Rotating magnet RM which may be an electromagnet, rotates on an axis 26 so as to permit either the north or the south pole to be brought into close proximity to the magnetic field of the poles 22 and 40. Rotation of the magnet RM causes the reed A to move from one pole to the other as the influence of the rotating magnet RM affects the force fields of the poles 22 and 24. Thus, when the north pole of the rotating magnet RM is introduced into the force field of the horseshoe magnet 16, it pushes against the north pole 22 and is additive with regard to the south pole 24 causing the reed A to be shifted in the direction of the south pole 24. Rotation again of the rotating magnet RM will cause a reversal of the process since now the south pole of the rotating magnet RM will be pushing against south pole 24 causing the reed A to be shifted towards the north pole 22 because of the additive effect. It will be obvious that the horseshoe magnet 16 may also be an electromagnet in which the horseshoe is the core upon which is wound a coil.

FIG. 6

In FIG. 6, as well as in the remaining FIGS. in this application, the encapsulation is not disclosed, and any encapsulation such as described in the prior art or in the previous FIGS. may be used. In this instance, the magnetic reed A is made to switch between non-magnetic reeds B and C. It will be noted that magnets 28 and 30 are repelling. Magnet 32 is positioned so that the pole axis of this magnet is perpendicular to the poles of magnets 28 and 30 and the S pole toward the magnets 28 and 30 as shown. By reciprocating the magnet 32 in the plane as indicated by the arrow, the reed A will be made to switch from left to right as in the solid to dotted line positions respectively. If we should invert the magnet 32 so that the poles are reversed from that shown in the drawing of FIG. 6, and if the magnet is sufficiently strong, although the poles of magnets 28 and 32 are repelling, there will be a switching action if the bottom pole is sufficient to override the pushing effect of the poles of magnets 28 and 32. In FIG. 6, if we use a stronger magnet for 32 than for magnets 28 and 30, we will see a very sharp action providing the magnet 32 has its bottom pole the reverse of the repelling poles of magnets 28 and 32.

FIG. 7

In FIG. 7, the reed A is flipped between the contacts B and C by action of the combined magnets 34, 36 and 38. It will be noted in this instance that the magnets 34 and 36 are opposing, but may be aiding rather than opposing as in FIG. 6. It will also be noted that the magnet 38 now has its polar axis parallel to the polar axis of magnets 34 and 36, rather than perpendicular thereto as in FIG. 6. By shifting the magnet 38 to the left as in the dotted line position, the reed will swing from right to left as illustrated. If now the magnet 38 is removed and magnet 40 is put into position as noted, the operation will be just the reverse in that the reed A will not follow the magnet as aforedescribed, but will shift away from the magnet. Thus, when magnet 40 is in the solid line position shown, the reed will be in the solid line position shown, and when magnet 40 is in the dotted line position shown, the reed will be in the dotted line position shown. It is obvious that a second magnet need not be used and that merely inverting magnet 38 is all that is necessary to provide an operating system such as magnet 40 shows. In any event, the system operates when either magnets 38 or 40 are used in the manner shown.

FIGS. 8, 9 AND 10

In FIGS. 8, 9 and 10, reed A may be positioned to operate between reeds B and C in a single pole-double throw operation or in a single throw situation (not shown). Magnets 42 and 44 are shown in aiding relationship but they may be in opposition. A housing is not shown but the reeds may be encapsulated therein. Shorting members 46 and 48 are of ferro magnetic material but are not magnetized. An opening in the housing (not shown) may be provided for insertion of the ferro magnetic members 46 and 48. The shunt member 46 is shown in the inserted position and the shunt 48 in the withdrawn position. When the ferro magnetic member 46 is inserted as shown, the reed A if it is in contact with reed B will switch to the right into contact with reed C. Similarly, insertion of member 48 and withdrawal of member 46 will cause the reed A to flip back from reed C to reed B.

In FIG. 9, touching the shunt 46 to the back of the magnet 42, or to the back of the magnet 44, will cause the reed A to flip in the direction of contact of the member 46 with the magnet 42 or the member 48 with the magnet 44. In FIG. 9, the ferro magnetic shunt or shorter 46 and 48 apparently strengthens the magnets 42 and 44 when they are placed in contact with their respective magnets.

In FIG. 10, the shorting members 46 and 48 are shown positioned about the magnet 42 only. Thus, when 46 is in contact with magnet 42, the reed A will be in contact with reed B. Once member 46 has been removed and member 48 inserted in front of magnet 42, the reed A will flip to the contact reed C and be retained in that position by magnet 44.

FIG. 11

In FIG. 11, reed A moves between contact reeds B and C which are as in the previous FIGS. non-ferro magnetic conductors. Reed A in all instances in this application is ferro magnetic and is hinged in the manner heretofore described in our previous applications. In these instances, it will be obvious that the permanent magnets can be substituted by electromagnets as generally shown in FIGS. 1, 2 and 4. The nature of the hinge is more specifically set out in our U.S. Pat. No. 3,866,007 of Feb. 11, 1975. In any event, the hinge should be less than 0.003 of an inch and preferably less than 0.001 of an inch in thickness. It should flex through an arc at least about 25° or greater than 25°. In FIG. 11, we have three stationary magnets 50, 52 and 54 and one movable magnet 56. Magnets 50 and 2 are aiding in the manner illustrated and magnet 54 may be generally shown as repeling magnet 50 and aiding magnet 52. If now magnet 56 is brought into position as shown in the solid lines in which it is opposing magnet 54, the ferro magnetic reed A will move into contact with the brass or non-ferro magnetic reed B. If then the magnet 56 is removed to the dotted line position, the reed A will then move to the dotted line position in contact with the reed C. In order for this system to operate property, magnets 54 and 56 should be repelling and magnets 50 and 52 should be aiding.

FIGS. 12 AND 13

Figure 12:
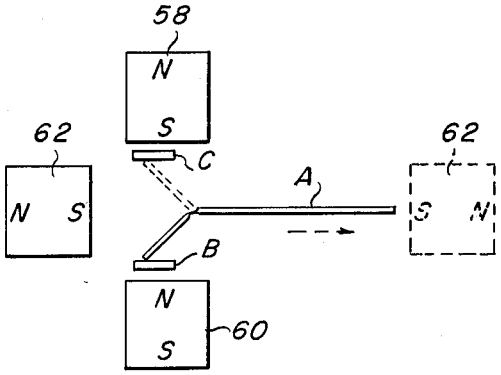
FIGS. 12 and 13 are side elevational views diagrammatically showing a first and second mode of operation of yet another embodiment of this invention.
Figure 13:
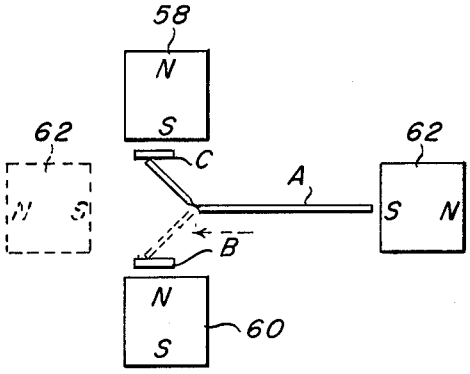

In FIGS. 12 and 13, reed A flexes between reeds B and C as in the manner aforementioned, and magnets 58 and 60 are aiding. FIG. 12 shows the first position in which the magnet 62 is to the left of the end of the reed A. As the magnet 62 is passed from the left to the right as in the dotted line position shown in FIG. 12, the reed A will flip from reed B to reed C. FIG. 13 shows the reverse operation in which the magnet 62 shown in solid line is moved to the left causing the reed A to flip from reed C back to reed B. As previously mentioned, reeds C and B may be conductive or one may be a stop rather than a reed. They are nonmagnetic and reed A is ferro magnetic.

FIGS. 14, 15 AND 16

Figure 14:
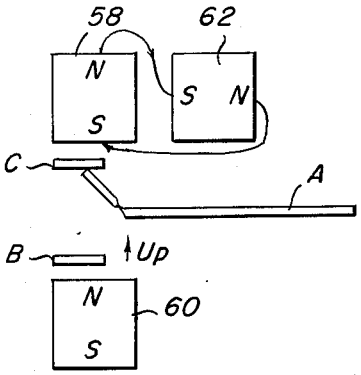
FIGS. 14, 15 and 16 are side elevational views diagrammatically showing three steps in the operation of yet another embodiment of this invention.
Figure 15:
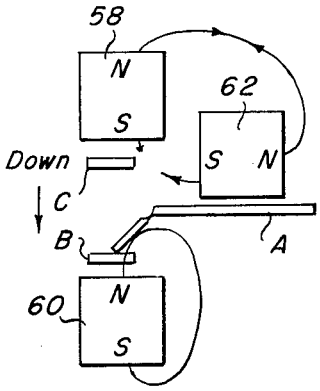
Figure 16:
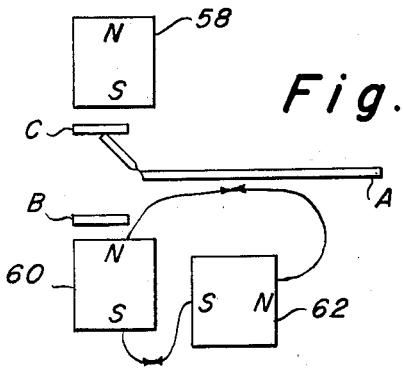

In FIGS. 14, 15 and 16, the magnet 62 illustrated in FIGS. 12 and 13 is now shifted to be somewhat above and behind the center axis of the aiding magnets 58 and 60. If now the magnet 62 is moved in slow increments from the position shown in FIG. 14 to the position shown in FIG. 15, the reed A will flip from the contact reed C to the contact reed B due to the change in magnetic field as illustrated in FIGS. 14 and 15. Upon continuation of the downward movement of the magnet 62 as shown in FIG. 16, reed A will then again move to the up position in contact with reed C due to the changing influence of the magnets 60 and 62 as illustrated diagrammatically. In this arrangement, if reed C is not connected to a circuit, there would be an off-on-off operation in a single shift of the magnet 62 in one direction. Reversal of the position of magnet 62 will, of course, reverse the operation to produce an on-off-on situation with contact reed B.

FIG. 17

Figure 17:
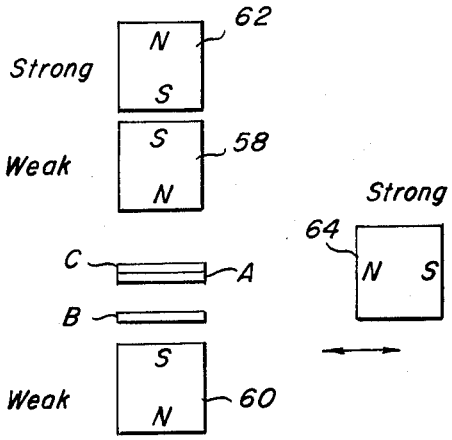
FIG. 17 is a side elevational view illustrating still a further embodiment of this invention.

FIG. 17 is illustrative of the capabilities of changing the intensity of the reed operation by adding stronger magnets to the magnets which would be affixed to the reed capsule (not shown). In this instance, magnets 58 and 60 are weak magnets. If reed A is in the down position in contact with reed B, the addition of the strong magnet 62 to the weak magnet 58 will cause the magnetic reed A to pull from contact B upward into contact with contact reed C. Similarly, the imposition of a strong magnet 64 will cause flipping operation in the manner heretofore shown and described in other switch systems.

While this invention has been described, it will be understood that it is capable of further modification, and the application is intended to cover any variations used and/or adaptations of the invention following, in general, the principle of the invention and including such departures from the present disclosure as come within known or customary practice in the art to which the invention pertains, and as may be applied to the essential features hereinbefore set forth, as fall within the scope of the invention or the limits of the appended claims.

Having thus described our invention what we claim is:

1. A reed switch comprising
a. a first reed of conductive magnetic material
b. a second reed of conductive non-magnetic material mounted in cooperating spaced relation to said first reed
c. a cooperating pair of magnetic operators mounted in spaced relation to said first and second reeds
d. said reeds being positioned between said pair of operators, and
e. a third operator cooperating with said pair of operators to influence one or the other of said operators to shift said first reed into a first mode or a second mode and latch said first reed in said mode.

2. A reed switch as in claim 1 and wherein:
a. said pair of magnetic operators are stationary and said third operator is movable.

3. A reed switch as in claim 1 and wherein:
a. said third operator is rotatable.

4. A reed switch as in claim 1 and wherein:
a. said third operator is linearly shiftable.

5. A reed switch as in claim 1 and wherein:
a. said third operator is a magnetic field shorter.

6. A reed switch as in claim 1 and wherein:
a. said third operator is a permanent magnet.

7. A reed switch as in claim 1 and wherein:
a. said third operator is an electromagnet.

8. A reed switch as in claim 1 and wherein:
a. at least one of said operators is an electromagnet.

9. A reed switch as in claim 1 and wherein:
a. said third operator is shiftable along the longitudinal axis of said reed.

10. A reed switch as in claim 1 and wherein:
a. said third operator is operator is shiftable along the vertica flex axis of said reed.

11. A reed switch as in claim 1 and wherein:
a. said third operator is shiftable along the vertical flex axis of said reed and at the end thereof.

12. A reed switch as in claim 1 and wherein:
a. said third operator is shiftable along the vertical flex axis of said reed and at the side edge thereof.

13. A reed switch as in claim 1 and wherein:
a. said pair of magnetic operators constitute two poles of a horseshoe magnet.

14. A reed switch as in claim 1 and wherein:
a. said third operator is a magnetic field shorter, and
b. said third operator is movable into position between one of said pair of magnets and said first reed.

15. A reed switch as in claim 1 and wherein:
a. said third operator is a magnetic field shorter, and
b. said third operator is movable into position adjacent the outer surface of one of said pair of magnetic operators.

16. A reed switch as in claim 1 and wherein:
a. said pair of operators are magnetically aiding.

17. A reed switch as in claim 16 and wherein:
a. said third operator for operation purposes has its polar axis transverse to the polar axis of said pair of operators.

18. A reed switch as in claim 16 and wherein:
a. said third operator for operation purposes has its polar axis parallel to the polar axis of said pair of operators.

19. A reed switch as in claim 1 and wherein:
a. said pair of operators are magnetically opposing.

20. A reed switch as in claim 9 and wherein:
a. said third operator for operation purposes has its polar axis transverse to the polar axis of said pair of operators.

21. A reed switch as in claim 9 and wherein:
a. said third operator for operation purposes has its polar axis parallel to the polar axis of said pair of operators.

22. A reed switch as in claim 1 and including:
a. a fourth operator for overriding one of said other operators.

23. A reed switch as in claim 1 and wherein:
a. said first reed includes a foil-thin flexible hinge.

24. A reed switch as in claim 23 and wherein:
a. said hinger has a thinness of less than 0.003 inches.

25. A reed switch as in claim 23 and wherein:
a. said hinge has a thinness of less than about 0.001 inches.

26. A reed switch as in claim 23 and wherein:
a. said hinge flexes through an arc of at least about 25°.

27. A reed switch as in claim 1 and wherein:
a. said third operator includes means for changing the direction of its polarity.

28. A reed switch as in claim 22 and wherein:
a. said fourth operator has its polar axis parallel to the polar axis of said third operator and transverse to the polar axis of said pair of magnetic operators.

29. A reed switch as in claim 28 and wherein:
a. said fourth operator is movable relative to said other operators.

30. A reed switch as in claim 29 and wherein:
a. said fourth and third operators are magnetically opposing.

31. A reed switch as in claim 30 and wherein:
a. said pair of operators are magnetically aiding.

* * * * *